US008825284B2

(12) United States Patent
Vawter et al.

(10) Patent No.: US 8,825,284 B2
(45) Date of Patent: Sep. 2, 2014

(54) AUTOMATIC FAN CURVE SELECTION

(75) Inventors: Michael D. Vawter, Franklin, IN (US); Long-Kung Hwang, Columbus, IN (US)

(73) Assignee: Cummins Inc., Columbus, IN (US)

( * ) Notice: Subject to any disclaimer, the term of this patent is extended or adjusted under 35 U.S.C. 154(b) by 402 days.

(21) Appl. No.: 12/185,064

(22) Filed: Aug. 1, 2008

(65) Prior Publication Data

US 2009/0164061 A1 Jun. 25, 2009

Related U.S. Application Data

(60) Provisional application No. 60/953,464, filed on Aug. 1, 2007.

(51) Int. Cl.
*G06F 7/00* (2006.01)
*F04D 27/02* (2006.01)

(52) U.S. Cl.
CPC ..... *F04D 27/02* (2013.01)
USPC ..... 701/36; 702/85

(58) Field of Classification Search
USPC ..... 701/1, 36, 33, 54; 702/85
See application file for complete search history.

(56) References Cited

U.S. PATENT DOCUMENTS 4,638,233 A * 1/1987 Erdman ..... 318/644
4,703,729 A 11/1987 Sakano et al.
5,365,436 A * 11/1994 Schaller et al. ..... 701/32.6
5,426,585 A * 6/1995 Stepper et al. ..... 702/85
5,765,525 A 6/1998 Ma
5,781,871 A * 7/1998 Mezger et al. ..... 455/424
6,272,402 B1 * 8/2001 Kelwaski ..... 701/1
6,360,704 B1 3/2002 Moriya et al.
6,386,155 B2 5/2002 Moriya et al.
6,397,800 B2 6/2002 Nohara et al.
6,538,887 B2 * 3/2003 Belady et al. ..... 361/695
6,772,060 B2 * 8/2004 McCauley et al. ..... 701/104
6,796,281 B2 9/2004 Shimoyama et al.
6,805,095 B2 10/2004 Sun et al.
6,904,352 B2 * 6/2005 Hawkins et al. ..... 701/101
6,920,387 B2 * 7/2005 Landes et al. ..... 701/102
7,310,959 B2 * 12/2007 Braun et al. ..... 62/178
2002/0082136 A1 * 6/2002 Endo et al. ..... 477/83
2002/0116114 A1 * 8/2002 Little ..... 701/114
2003/0095298 A1 * 5/2003 Chizawa ..... 358/505
2003/0109977 A1 * 6/2003 Landes et al. ..... 701/54
2005/0090940 A1 * 4/2005 Pajakowski et al. ..... 701/1
2005/0128700 A1 * 6/2005 Alperin et al. ..... 361/687
2005/0134284 A1 * 6/2005 Hoff et al. ..... 324/511
2006/0072016 A1 * 4/2006 Shiohara ..... 348/207.2
2006/0113842 A1 * 6/2006 Pail ..... 307/28
2006/0149434 A1 * 7/2006 Bertosa et al. ..... 701/29
2007/0061173 A1 * 3/2007 Gay ..... 705/4

* cited by examiner

*Primary Examiner* — Helal A Algahaim
*Assistant Examiner* — Shardul Patel
(74) *Attorney, Agent, or Firm* — Krieg DeVault LLP

(57) ABSTRACT

A method and system for use in a vehicle. The method includes providing a plurality of fan curves in a vehicle, requesting vehicle information, and selecting a fan curve from the plurality of fan curves based on the vehicle information.

10 Claims, 6 Drawing Sheets

Model Series 5000
Model Series 5000, 5000 Series Premium On/Off Highway
Models:

DF55700 5500I 6X4
DG55700 5500 SFA 2X0 GLIDER 114'' BBC
DR55700 5500I 4X4
DX55700 5500I 6X6
DF56700 5500I 6X4
DF56700 5600 SBA 2X0 GLIDER 114'' BBC
DR56700 5600I 4X4
DW56700 5600 SBA 8X4 114'' BBC
DX56700 5600I 6X6
DY56700 5600 SBA 8X6 114'' BBC
DZ56700 5600I 8X6 TRIDEM
DA59700 5900I SFA 4X2
DF59700 5900I SFA 6X4
DF69700 5900I SBA 6X4
DZ59700 5900I SFA 8X6 TRIDEM
DZ69700 5900I SBA 8X6 TRIDEM

Model Family 7600
Model Family 7600, 7600 Severe Service
Models:

SA54700 7600 SFA 4X2
SA64700 7600 SBA 4X2
SF54700 7600 SFA 6X4
SF64700 7600 SBA 6X4

Model Family 7700
Model Family 7700, 7700 Severe Service
Models:

SA55700 7700 SFA 4X2
SF55700 7700 SFA 6X4
SF65700 7700 SBA 6X4

Model Family 8600
Model Family 8600, Heavy Diesel Tractors
Models:

RA02700 8600 SBA 4X2
RF02700 8600 SBA 6X4

Model Series 9000
Model Series 9000, 9000 Series Cabover & Conventional
Models:

| | |
|---|---|
| 5500 | Prefix List |
| 5600 | DF |
| 5900 | DR |
| 9200 | DX |
| | DY |
| | DZ |
| | DA |
| | SA |
| | SF |
| | RA |
| | RF |
| | L2 |
| | L9 |
| | N2 |
| | N9 |
| | R2 |
| | R9 |
| | LA |
| | LF |

FIG. 4

L265700 9200 SBA 4X2
L275700 9200 SBA 6X4
L277700 9200 SBA GLIDER
L921700 9200I SBA 4X2
L922700 9200I SBA 6X4
L923700 9200I SBA GLIDER
N275700 9200 SBA 6X4 MEXICO
N922700 9200I SBA 6X4 MEXICO
R265700 9200 SBA 4X2 BRAZIL
R275700 9200 SBA 6X4 BRAZIL
R921700 9200I SBA 4X2 BRAZIL
R922700 9200I SBA 6X4 BRAZIL

9400

L205700 9400 SBA 4X2
L215700 9400 SBA 6X4
L217700 9400 SBA GLIDER
L941700 9400I SBA 4X2
L942700 9400I SBA 6X4
L943700 9400I SBA GLIDER
N215700 9400 SBA 6X4 MEXICO
N942700 9400I SBA 6X4 MEXICO

9900

L293700 9900 SFA 6X4
L296700 9900 SFA GLIDER
L931700 9400I SFA 4X2
L932700 9900I SFA 6X4
L933700 9900I SFA GLIDER
L935700 9900IX SFA 6X4
L936700 9900IX SFA GLIDER

Model Synonym M-NGV-LH, ALL PROSTAR MODELS
Models:

999C100 NGV TEST CAB
LA61700 PROSTAR 4X2
LA62700 PROSTAR PREMIUM 4X2
LA63700 PROSTAR LIMITED 4X2
LA64700 PROSTAR 4X2S
LA65700 PROSTAR PREMIUM 4X2S
LF66700 PROSTAR LIMITED 4X2S
LF61700 PROSTAR 6X4
LF62700 PROSTAR PREMIUM 6X4
LF63700 PROSTAR LIMITED 6X4
LF64700 PROSTAR 6X4S
LF65700 PROSTAR PREMIUM 6X4S
LF66700 PROSTAR LIMITED 6X4S

FIG. 5

| T_GTIS_OEMName | T_GTIS_OEMName - Converted | T_GTIS_OEMVehicleOrEquipmentID | T_GTIS_OEMVehicleOrEquipmentID-Converted |
|---|---|---|---|
| 49 | I | 4C | L |
| 4E | N | 46 | F |
| 54 | T | 36 | 6 |
| 45 | E | 33 | 3 |
| 52 | R | 37 | 7 |
| 4E | N | 30 | 0 |
| 41 | A | 30 | 0 |
| 54 | T | 0 | nul |
| 49 | I | 0 | nul |
| 4F | O | 0 | nul |
| 4E | N | 0 | nul |
| 41 | A | 0 | nul |
| 4C | L | 0 | nul |
| 0 | nul | 0 | nul |
| 0 | nul | 0 | nul |

FIG. 6

AUTOMATIC FAN CURVE SELECTION

CROSS REFERENCE TO RELATED APPLICATION

This Application is the U.S. Non-Provisional Patent Application which claims priority to U.S. Provisional Patent Application No. 60/953,464, filed Aug. 1, 2007, entitled "AUTOMATIC FAN CURVE SELECTION" a portion of which is incorporated herein by this reference.

RELATED CO-PENDING PATENT APPLICATIONS

The present invention is related to a provisional U.S. application, Application No. 60/953,464, filed on Aug. 1, 2007, and entitled "Automatic Fan Curve Selection," which is herein incorporated by reference.

FIELD OF THE INVENTION

The present invention relates to vehicles, and more particularly to a method and system involving fan curve information of a vehicle.

BACKGROUND OF THE INVENTION

Many transmissions require the engine system of a vehicle to accurately broadcast via a datalink the amount of torque that the engine is creating as well as the amount of torque being consumed by internal and external parasitic losses. The engine system typically estimates the amount of torque being consumed by internal parasitic losses. However, the engine system cannot accurately determine the torque consumed by the largest external parasitic loss, the engine's cooling fan.

Accordingly, what is needed is an improved method and system for processing fan curve information. The present invention addresses such a need.

SUMMARY OF THE INVENTION

A method and system for use in a vehicle is disclosed. In one embodiment, the method includes providing a plurality of fan curves in a vehicle, requesting vehicle information, and selecting a fan curve from the plurality of fan curves based on the vehicle information. According to the method and system disclosed herein, embodiments of the present invention provide accurate fan torque selection and compensation.

BRIEF DESCRIPTION OF THE DRAWINGS

FIG. 4 illustrates an example table showing fan curves for different engines in accordance with one embodiment.

FIG. 5 illustrates an example table showing fan curves for different engines in accordance with another embodiment.

FIG. 6 illustrates a table of information programmed into an engine data plate for a particular engine in accordance with one embodiment.

DETAILED DESCRIPTION OF THE INVENTION

The present invention relates to vehicles, and more particularly to a method and system involving fan curve information of a vehicle. The following description is presented to enable one of ordinary skill in the art to make and use the invention, and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

A method and system in accordance with the present invention involving fan curve information are disclosed. The method includes causing the engine electronic control module (ECM) to send a request message to a vehicle cab controller for vehicle information. In one embodiment, the vehicle information includes the vehicle make and model. If a response message is received, the ECM identifies the vehicle information from the response message, and selects a fan curve based on the vehicle information. As a result, embodiments of the present invention provide accurate fan torque selection and compensation. To more particularly describe the features of the present invention, refer now to the following description in conjunction with the accompanying figures.

Figure 1:
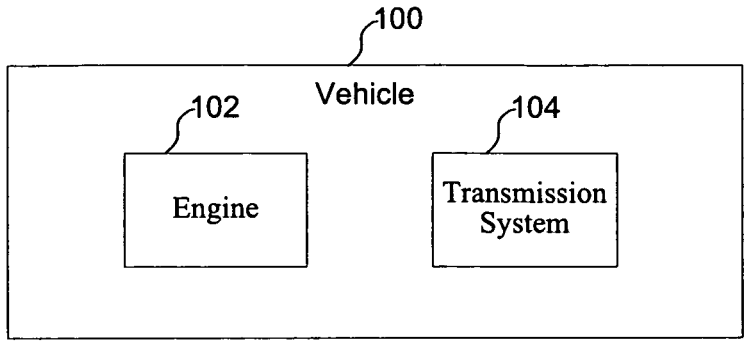
FIG. 1 is a block diagram of a vehicle in accordance with one embodiment.
Figure 2:
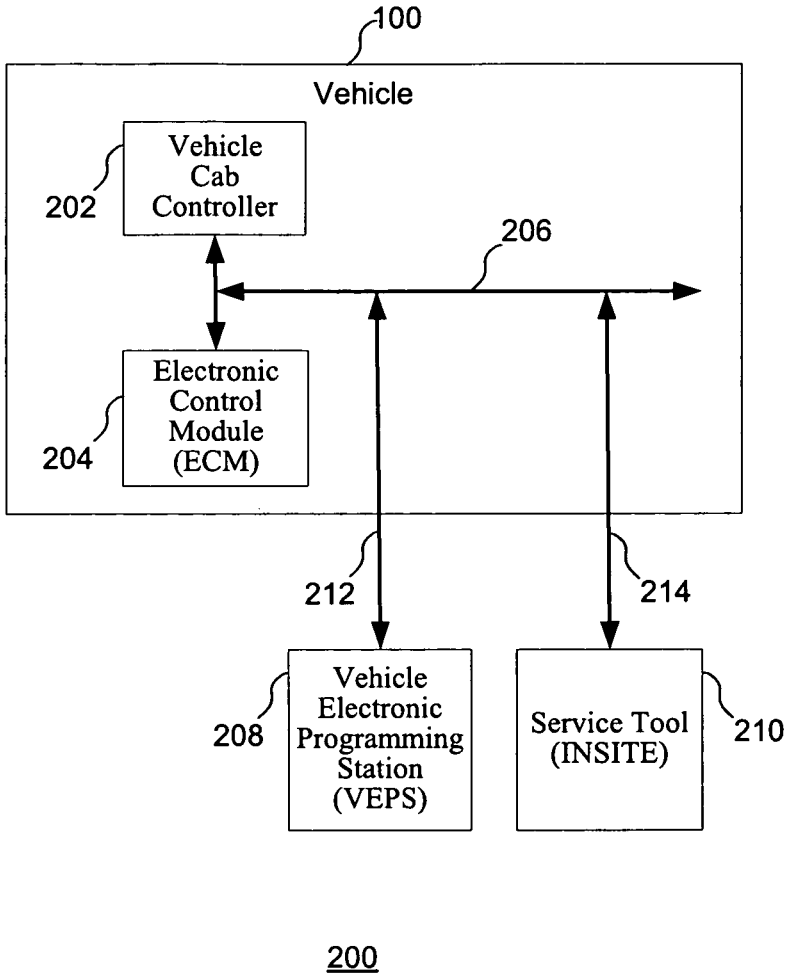
FIG. 2 is a block diagram of a vehicle in accordance with one embodiment.

FIG. 1 is a block diagram of a vehicle 100 in accordance with one embodiment. As FIG. 1 shows, the vehicle 100 includes an engine 102 and a transmission system 104. FIG. 2 is a block diagram of a fan curve selection system 200 in accordance with another embodiment. As FIG. 2 shows, the fan curve selection system 200 includes a vehicle cab controller 202 and an engine electronic control module (ECM) 204, which communicate via a datalink backbone 206. In one embodiment, the ECM 204 and vehicle cab controller 202 operate with the transmission system to provide a powertrain system. The vehicle cab controller 202, ECM 204, and datalink backbone 206 are part of the vehicle 100. In a specific embodiment, the datalink backbone 206 is a J1939 datalink backbone. The fan curve selection system 200 also includes a vehicle electronic programming station (VEPS) 208 and a service tool 210, both of which couple to the datalink backbone via respective datalinks 212 and 214. In one embodiment, the VEPS 208 may be used to program the ECM 204 at the original equipment manufacturer (OEM) factory. In a specific embodiment, the service tool 210 may be used to transfer factory settings from a "failed" ECM to a new ECM. In a specific embodiment, the service tool 210 is a Cummins service tool (INSITE).

Figure 3:
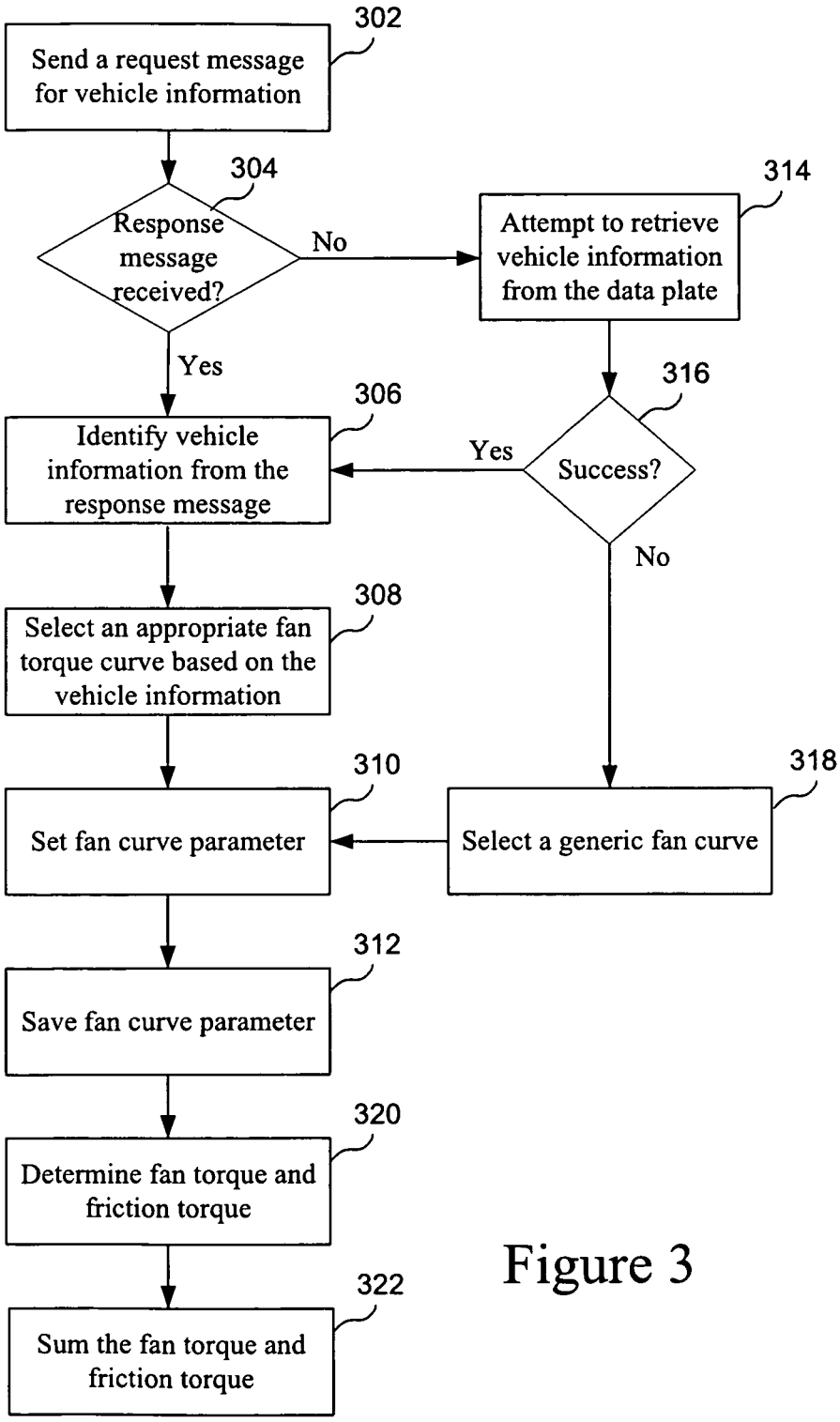
FIG. 3 is a flow chart showing a method for selecting a fan curve in accordance with one embodiment.

FIG. 3 is a flow chart showing a method for selecting a fan curve in accordance with one embodiment. Referring to both FIGS. 2 and 3 together, the process begins in step 302, when the ECM 204 requests vehicle information by sending a request message (e.g., component ID message) for vehicle information to the vehicle's cab controller 202, over the datalink backbone 206. In one embodiment, the vehicle identification message includes vehicle make and vehicle model information. In one embodiment, step 302 is performed at each engine key-on of the vehicle. As such, every time the engine key is turned on, a check is made as to the fan curve information. The ECM 204 is constantly observed so that the correct fan curve is determined, no matter what happens with the ECM 204. In the rare occurrence that the ECM 204 has gone bad in a particular truck, and the engine does not operate, there may be another truck that has a good ECM. Accordingly, the good ECM on the latter truck may be used to replace the bad in ECM on the former truck.

Next, in step 304, the ECM 204 determines if it has received a response message from the cab controller 202. If the ECM 204 receives a response message, in step 306, the ECM 204 identifies the vehicle information (e.g., vehicle make and model) from the response message. Next, in step 308, the ECM 204 selects an appropriate fan curve based on the vehicle information. In one embodiment, the ECM 204 initially stores fan curves for various makes and models. In one embodiment, a fan curve may indicate a fan make, fan model, drive ratio, number of blades, and fan diameter that is connected to the engine. FIG. 4 illustrates an example table showing fan curves for different engines in accordance with one embodiment. FIG. 5 illustrates an example table showing fan curves for different engines in accordance with another embodiment. FIGS. 4 and 5 show example vehicle makes and models that may be offered by one vehicle OEM. In one embodiment, each model family has one fan option. For example, referring to FIG. 4, all 7700 model family vehicles have the same fan.

Referring again to FIG. 3, in step 310, the ECM 204 sets a fan curve parameter with an index number that corresponds to the selected fan curve. The fan curve parameter is also referred to as an "Active Fan Curve" parameter. Next, in step 312, the ECM 204 saves the fan curve parameter. In one embodiment, the ECM 204 saves the fan curve parameter permanently. In one embodiment, step 312 is performed at each engine key-off of the vehicle. Zone Name: a2,AMD Referring again to step 304, if the ECM 204 does not receive a response message from the vehicle cab controller 202, in step 314, the ECM 204 attempts to retrieve the vehicle information (e.g., make and model) from a data plate. In one embodiment, a data plate is a portion of the ECM 204 that stores vehicle information such as vehicle make and model. When a given vehicle is built, the ECM includes a data plate, regardless of the manufacturer. FIG. 6 illustrates a table of information programmed into an engine data plate for a particular engine in accordance with one embodiment.

Referring again to FIG. 3, in step 316, the ECM 204 determines if it is successful in retrieving the vehicle information from the data plate. If so, in step 306, the ECM 204 selects an appropriate fan curve based on the vehicle information, and then sets and saves the fan curve parameter. If the vehicle information is not available from the data plate, in step 318, the ECM 204 selects a generic fan curve, and then sets and saves the fan curve parameter. In one embodiment, engines are shipped with the fan curve parameter set to the index value for the generic fan curve.

Next, in step 320, the ECM 204 determines the fan torque from the selected fan curve and determines the friction torque. In one embodiment, the friction torque is a parameter that indicates the amount of torque being consumed by parasitic losses or accessory loads. Next, in step 322, the ECM 204 sums the fan torque and friction torque. In conventional systems, the friction torque is not available for use by the transmission. For example, under a quasi steady-state no-load condition, the broadcasted value of actual engine torque will increase by some amount when the fan comes on. The amount of increase is directly proportional to the amount of fan load. If the engine does not increase the value of friction torque by the correct corresponding amount, the transmission will interpret the increase as a change in grade which may result in poor shift decisions. Embodiments of the present invention eliminate this problem by summing the fan torque with the friction torque to eliminate the torque error. The ECM 204 may then broadcast an accurate torque for the vehicle, as the proper torque curve is used to compensate for the fan.

In one embodiment, if the ECM 204 had previously selected a non-generic fan curve, and if there is no response to the ECM's current request for vehicle information, the ECM 204 may use the current value of fan curve parameter and set a fault indicating a loss of communication with the cab controller 202. In one embodiment, a provision may be provided to clear the fault in order to accommodate the case where an ECM is removed from the engine installed in one vehicle make and then installed on an engine in another vehicle of a different make and model. In one embodiment, a single fan curve may be scalable. In one embodiment, an in-service fan power estimation algorithm may be used.

According to the method and system disclosed herein, the present invention provides numerous benefits. For example, embodiments of the present invention provide accurate fan torque selection and compensation and provide an accurate broadcast of engine torque when the fan is on. Embodiments also allow the ECM to determine and apply the proper fan curve without human intervention, thereby eliminating the possibility of a fan curve being erroneously selected. Embodiments also improve engine and transmission performance. Embodiments also eliminate shift inhibits due to inaccurate broadcast torque. Embodiments also require no additional electronic tool support. Embodiments also reduce the amount of time, resources, and expense required to obtain transmission certification. Embodiments also eliminate or minimize the amount of fan torque compensation validation testing.

A method and system in accordance with the present invention involving fan curve information has been disclosed. The method includes engine electronic control module (ECM) sending a request message to a vehicle cab controller for vehicle information. If a response message is received, the ECM identifies the vehicle information from the response message and selects a fan curve based on the vehicle information. As a result, embodiments of the present invention provide accurate fan torque selection and compensation.

The present invention has been described in accordance with the embodiments shown. One of ordinary skill in the art will readily recognize that there could be variations to the embodiments, and that any variations would be within the spirit and scope of the present invention. For example, embodiments of the present invention may be implemented using hardware, software, a computer-readable medium containing program instructions, or a combination thereof. Software written according to the present invention or results of the present invention may be stored in some form of computer-readable medium such as memory, hard drive, CD-ROM, DVD, or other media for subsequent purposes such as being executed or processed by a processor, being displayed to a user, etc. Also, software written according to the present invention or results of the present invention may be transmitted in a signal over a network. In some embodiments, a computer-readable medium may include a computer-readable signal that may be transmitted over a network. Accordingly, many modifications may be made by one of ordinary skill in the art without departing from the spirit and scope of the appended claims.

What is claimed is:

1. A method, comprising:

providing a system comprising a vehicle, a vehicle controller configured to control one or more aspects of operation of the vehicle, an engine, an engine controller configured to control one or more aspects of operation of the engine, and a communication link operatively coupled with the vehicle controller and operatively coupled with the engine controller;

operating the engine controller to request first vehicle identifying information from the vehicle controller;

if said first vehicle identifying information is received by the engine controller, operating the engine controller to select a fan torque curve based upon said first information, estimate a fan torque based upon the fan torque curve, adjust a friction torque of the engine based upon the estimated fan torque, and transmit adjusted friction torque information over the communication link;

if said first information is not received by the engine controller, operating the engine controller to read second vehicle identifying information from an electronic data plate of the engine controller;

if said second vehicle identifying information is read by the engine controller, operating the engine controller to select a fan torque curve based upon said second information, estimate a fan torque based upon the fan torque curve, adjust a friction torque of the engine based upon the estimated fan torque, and transmit adjusted friction torque information over the communication link; and if said second vehicle identifying information is not read by the engine controller, operating the engine controller to select a generic fan torque curve, estimate a fan torque based upon the generic fan torque curve, adjust a friction torque of the engine based upon the estimated fan torque, and transmit adjusted friction torque information over the communication link.

2. The method of claim 1, wherein the engine controller is configured to estimate each of said fan torques based upon at least one operation selected from the operations consisting of: selecting a fan curve from a plurality of fan curves, setting a fan curve parameter with an index corresponding to a selected fan curve, scaling a fan curve, and operating an in-service fan power estimation algorithm.

3. The method of claim 1, wherein each of said acts of estimating a fan torque comprises selecting a fan curve comprising at least one parameter selected from the parameters consisting of a fan make, a fan model, a drive ratio, a number of blades, and a fan diameter.

4. A method, comprising:

operating a system comprising a vehicle controller an engine controller, a transmission controller, and a communication link in operative communication with the vehicle controller, the engine controller, and the transmission controller;

operating the engine controller to request first vehicle make and model information from the vehicle controller;

if said first vehicle make and model information is received by the engine controller, operating the engine controller to select a fan torque characteristic based upon said first information, estimate a fan torque based upon the fan torque characteristic, adjust a friction torque of the engine based upon the estimated fan torque, and transmit adjusted friction torque information over the communication link;

if said first information is not received by the engine controller, operating the engine controller to attempt to read second vehicle make and model information from a non-transitory memory device of the engine controller;

if said second vehicle make and model information is read by the engine controller, operating the engine controller to select a fan torque characteristic based upon said second information, estimate a fan torque based upon the fan torque characteristic, adjust a friction torque of the engine based upon the estimated fan torque, and transmit adjusted friction torque information over the communication link;

if said second vehicle make and model information is not read by the engine controller, operating the engine controller to select a default fan torque characteristic, estimate a fan torque based upon the default fan torque characteristic, adjust a friction torque of the engine based upon the estimated fan torque, and transmit adjusted friction torque information over the communication link;

wherein the transmission controller is configured to execute a transmission control routine based at least in part on the adjusted friction torque.

5. The method of claim 4, wherein the the engine controller is configured to estimate each of said fan torques based upon at least one operation selected from the operations consisting of: selecting a fan curve from a plurality of fan curves, setting a fan curve parameter with an index corresponding to a selected fan curve, scaling a fan curve, and operating an in-service fan power estimation algorithm.

6. The method of claim 4, wherein each of said acts of estimating a fan torque comprises selecting a fan curve comprising at least one parameter selected from the parameters consisting of a fan make, a fan model, a drive ratio, a number of blades, and a fan diameter.

7. A method, comprising:

providing a vehicle s system comprising a vehicle controller an engine controller a transmission controller, and a communication link operatively coupled with the vehicle controller, the engine controller, and the transmission controller;

operating the engine controller to request first vehicle identifying information from the vehicle controller;

if the engine controller receives the first vehicle first vehicle identifying information, operating the engine controller to perform a torque determination operation based upon the first vehicle identifying information;

if the engine controller does not receive the first vehicle identifying information, operating the vehicle controller to attempt to obtain second vehicle identifying information from an electronic data plate of the engine controller;

if the engine controller obtains the second vehicle identifying information, operating the engine controller to perform the torque determination operation based upon the second vehicle identifying information;

if the engine controller does not obtain the second vehicle identifying information, operating the engine controller to perform the torque determination operation based upon generic information; and providing an output of the torque determination as a control input to the transmission controller effective to control operation of the transmission controller;

wherein the torque determination operation comprises selecting a fan torque curve based upon one of the first vehicle identifying information, the second vehicle first vehicle identifying information and the default information, setting a fan curve parameter based upon the fan torque curve, determining fan torque based upon the fan torque parameter, determining a friction torque of the engine, and determining the output of the torque determination based upon the fan torque and the friction torque.

8. The method of claim 7, wherein the selected one of the plurality of fan curves comprises a parameter selected from the parameters consisting of a fan make, a fan model, a drive ratio, a number of blades, and a fan diameter.

9. A method, comprising:

providing a system comprising a vehicle, a vehicle cab controller, an engine, an engine control module (ECM), a transmission, a transmission control module (TCM), and a communication link structured to provide communication between the vehicle cab controller, the ECM and the TCM;

requesting with the ECM first vehicle make and model information from the vehicle cab controller;

if the ECM receives the first vehicle first vehicle make and model information, operating the ECM to perform a torque determination operation based upon the first vehicle first vehicle make and model information;

if the ECM does not receive the first vehicle make and model information, attempting to read with the ECM second vehicle make and model information stored in a non-transitory memory device of the ECM;

if the ECM reads the second vehicle make and model information, operating the ECM to perform the torque determination operation based upon the second vehicle make and model information;

if the ECM does not read the second vehicle make and model information, operating the ECM to perform the torque determination operation based upon default information; and providing an output of the torque determination as a control input to the TCM effective to influence operation of the TCM in controlling the transmission;

wherein the torque determination operation comprises selecting a fan torque curve based upon one of the first vehicle make and model information, the second vehicle first vehicle make and model information and the default information, setting a fan curve parameter based upon the fan torque curve, determining fan torque based upon the fan torque parameter, determining a friction torque of the engine, and determining the output of the torque determination based upon the fan torque and the friction torque.

10. The method of claim 9, wherein the selected one of the plurality of fan curves comprises a parameter selected from the parameters consisting of a fan make, a fan model, a drive ratio, a number of blades, and a fan diameter.

* * * * *